US005857419A

United States Patent [19]

Van Eerden et al.

[11] Patent Number: 5,857,419

[45] Date of Patent: Jan. 12, 1999

[54] CONVERGING BURNER TIP

[75] Inventors: John J. Van Eerden, Churchville; A. John Grever, Colmar; John J. Bloomer, Holland, all of Pa.

[73] Assignee: Selas Corporation of America, Dresher, Pa.

[21] Appl. No.: 666,252

[22] Filed: Jun. 20, 1996

[51] Int. Cl.[6] ..... F23C 1/02

[52] U.S. Cl. ..... 110/260; 110/101 R; 110/101 CF; 431/181; 431/350

[58] Field of Search ..... 110/261, 260, 110/101 R, 104 B, 101 CF, 101 CB; 431/8, 12, 181, 187, 350, 351, 352, 354

[56] References Cited

U.S. PATENT DOCUMENTS 3,153,438 10/1964 Brzozowski .
3,529,917 9/1970 Hindenlang .
3,695,820 10/1972 Hawkes et al. .
3,936,003 2/1976 Hapgood et al. .
4,082,495 4/1978 Lefebvre .
4,203,718 5/1980 Tracy .
5,011,400 4/1991 Vatsky .
5,392,720 2/1995 Briggs et al. .
5,408,943 4/1995 Vatsky .
5,487,659 1/1996 Eroglu et al. ..... 431/350

*Primary Examiner*—Henry A. Bennett
*Assistant Examiner*—Pamela A. Wilson
*Attorney, Agent, or Firm*—Austin R. Miller

[57] ABSTRACT

A burner tip having a converging portion with a multiplicity of ports. The ports are sized and positioned so that a substantially constant ratio is maintained between any selected cross-sectional flow area within the converging portion and the sum of the port areas downstream from that cross-sectional flow area, thereby maintaining a substantially constant pressure within the tip. A disk is positioned at a downstream portion of the converging portion to flatten the flame.

15 Claims, 1 Drawing Sheet

CONVERGING BURNER TIP

FIELD OF THE INVENTION

The invention relates to a converging burner tip for a burner adapted for burning a fuel-air mixture in a furnace. Particularly, the invention relates to a burner tip which is capable of maintaining a substantially constant pressure within the tip throughout a wide turndown range, and is capable of promoting good flame stability even at high flow rates.

BACKGROUND OF THE INVENTION

Burner tips for commercial use in furnaces are subjected to a variety of important requirements, including capacity requirements, flame shape, flame stability and backfire resistance. It has been a longstanding challenge in the art to design a tip which provides superior backfire resistance without sacrificing capacity, flat-flame capability or excellent flame stability at high flow rates.

Prior art burner tips fail to address a primary cause of backfire, which has been found to be uneven pressure within the tip. U.S. Pat. No. 5,011,400 to Vatsky discloses a cone-shaped burner tip having four pie-shaped openings which admit secondary air into the nozzle to mix with the fuel. There is no suggestion for maintaining constant pressure within the tip, nor does the reference suggest a way to prevent backfire or to prevent the flame from blowing itself out when operating at a high flow rate of the air-fuel mixture.

U.S. Pat. No. 3,529,917 to Hindenlang discloses an air-mixing device for a burner which comprises a frusto-conical air-mixing and directing member which is provided with a plurality of air passage holes. The frusto-conical member converges and compresses a substantial portion of the combustion air, while the air passage holes divert a portion of the combustion air to the periphery of the throat opening to create turbulence. This turbulence is intended to cause thorough mixing of fuel and combustion air, and to increase the cross-sectional area and solidity of the flame. However, there is no suggestion of means for maintaining fuel-air pressure control within the burner tip, or of achieving enhanced flame dynamics.

There remains a need in the art for a burner tip which controls backfire while providing high capacity burner stability and flat-flame capability.

OBJECT OF THE INVENTION

It is an object of the invention to provide a high capacity burner tip having enhanced backfire resistance and excellent flat-flame capability along with good flame stability even at high heat rates.

Other objects and advantages of the invention will further become apparent from the appended drawings and the description of the invention provided below.

SUMMARY OF THE INVENTION

Figure 1:
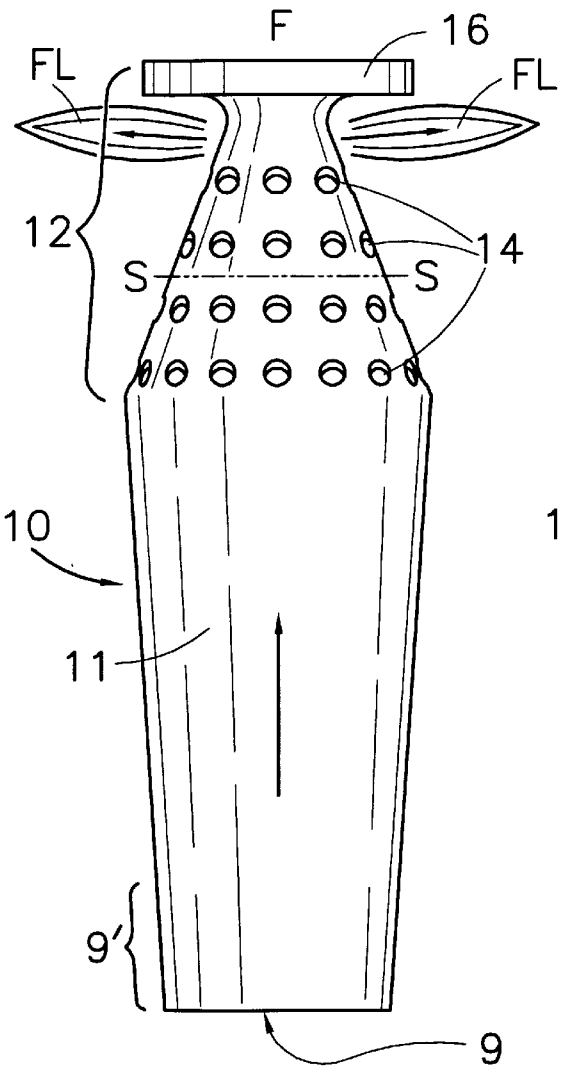
FIG. 1 is a schematic drawing of one embodiment of a burner tip in accordance with the invention.

This invention comprises a burner tip which converges in the direction of the fuel flow path. The converging portion is provided with a multiplicity of specifically sized and positioned ports or apertures, and also has a transversely arranged deflector at its distal portion. The converging shape of the tip coacts with the open areas of the ports to maintain a substantially constant fluid pressure within the tip; as the sum of the downstream port areas decreases along the converging member, the cross-sectional flow area of the tip proportionally decreases, thereby providing a substantially constant fluid pressure within the tip along its length. Backfire resistance is significantly enhanced.

It is also important in accordance with this invention to reduce the total surface area of the tip as compared to a cylindrical tip of the same length and inlet diameter.

A transverse plate or disk is preferably positioned at a downstream portion of the converging tip and helps to produce a substantially flat flame and by directing the flame along the neighboring surfaces of a furnace wall.

The transverse disk is preferably, but not necessarily, attached to the burner tip by a bolt, with the bolt partially obstructing at least some ports on the conical member to improve flame stability.

DETAILED DESCRIPTION OF THE INVENTION

Preferred embodiments of the invention will now be described in specific terms with reference to the figures. The description is directed to the embodiments selected for illustration in the drawings, and is not intended to limit the scope of the appended claims.

Figure 2:
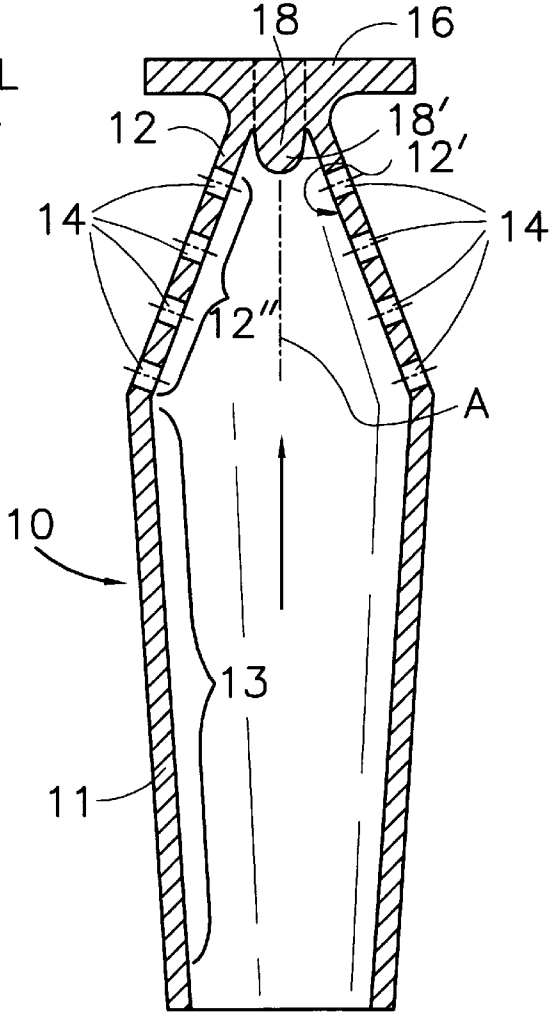
FIG. 2 is the burner tip embodiment depicted in FIG. 1, taken in axial section for ease of understanding.

Turning to FIGS. 1 and 2 of the drawings, the number 9 designates the burner inlet, and the converging wall of the tip is shown as a portion of a cone to provide a cone-shaped burner nozzle 12' (FIG. 2). Conical member 12 (designated by the bracket in FIG. 1); is provided with a plurality of ports 14. The downstream portion of nozzle 12' is shown as 12" in FIG. 2. It is important to observe that ports 14 are positioned and sized to maintain a substantially constant ratio between each cross-sectional flow area of conical member 12 and the sum of these port areas that are located downstream from that cross-sectional flow area.

A flattening plate or disk 16 is positioned on the distal portion of conical member 12, while the burner body 11 is provided at the proximal portion of conical member 12 and has outwardly diverging walls.

In FIG. 2, the cone-shaped burner tip of FIG. 1 is shown in section thereby revealing bolt 18, which may be used to attach the disk 16 to the conical member 12. Burner body 11 and conical member 12 define a passage 13 for the flow of the requisite fuel-air mix, which may be a premix or formed by inspiration in a manner known per se.

When in use in a furnace the mixture of air and fuel advances axially along the passage 13 to the conical member 12. Ports 14 may be unequal or preferably equal areas and are sized and positioned to maintain a substantially constant ratio obtained by determining the cross-sectional flow area at any given cross section S—S of conical member 12, divided by the sum of all port areas that are located downstream of the same cross section. This has been discovered to provide a substantially constant pressure within conical member 12 over a wide range of flow velocities. This substantially constant pressure has been found to significantly enhance the overall backfire resistance of the tip to and to achieve other important advantages to be discussed in detail in this specification. Preferably the ratio of the downstream port area to the cross-sectional flow area is about one at most at every cross section of the tip. Accordingly it will be evident that the openings 14 are sized and positioned on their wall so that a ratio between a given cross-sectional area of said tip passage containing the burner tip openings and the sum of the areas of the openings located downstream of that cross-sectional area remains substantially constant through the length of the tip portion 12.

Transversely-extending deflector 16 coacts with the arrangement of openings 14 to produce a flat flame, directing the flame from the burner tip in a substantially flat form along surrounding portions of the furnace wall as indicated by the arrows in FIG. 1. Bolt 18 partially obstructs some of ports 14 and this has been found, in some cases, to improve flame stability.

Figure 3:
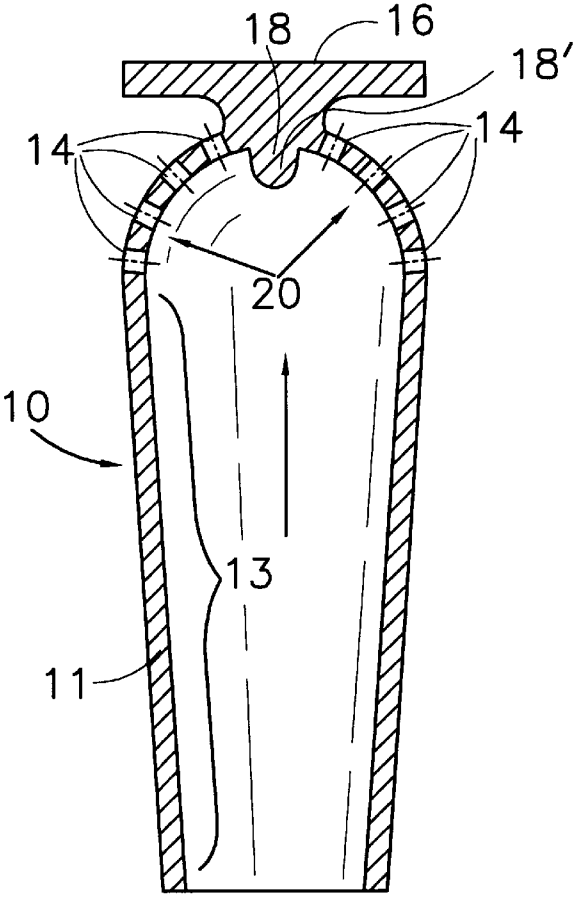
FIG. 3 is a similar sectional view of an alternative form of the invention.

FIG. 3 shows an alternative form in which the tip has a generally spherical converging wall 20, here shown in the form of a hemisphere. It can be provided in various forms encompassing more or less than one-half of a sphere and is highly advantageous in view of its minimization of surface area exposure to the hottest portion of the furnace.

It has been discovered that, in addition to maintaining a substantially constant pressure within the tip, the converging shape of the tip minimizes tip surface area to reduce the amount of heat collected by the tip, particularly when the tip is intended to project relatively deeply into a hot furnace. The less heat the tip collects, the greater the improvement in backfire resistance.

It will be appreciated that the provision of the flat plate or disk 16 downstream of the openings 14 enhances fluid dynamics outwardly of the tip and shields against the furnace environment in order to stabilize the flame. This happens even in the event of very high throughput of a fuel-air mixture in the direction of the arrow through the burner body 11 and is an important and advantageous feature of the invention.

Additionally, excellent backfire resistance is provided in accordance with this invention by minimizing the presence of laminar flow in view of the inwardly curved configuration of the burner tip. A burner in accordance with this invention has a remarkable capability of resisting backfire even at low rates of flow.

In accordance with this invention, it is possible to obtain radically increased throughput of fuel-air mixture for a given barrel size of the burner body 11, allowing the throughput to be increased far beyond the usual while stabilizing the flame so that the flame will not extinguish itself.

It is preferred in accordance with this invention that the holes provided in the converging portion of the burner tip have a greater total area than the cross section of the burner barrel 11 as it exists adjacent to the converging tip end portion.

It will accordingly be apparent that the burner tip openings 14 are sized and positioned so that the cross-sectional area of substantially any cross section of the tip portion is substantially equal to, or less than, the sum of the areas of those openings 14 that are located at and downstream of the cross-sectional area throughout the burner tip portion 12.

This invention is applicable to a wide variety of curvatures of the inwardly converging, perforated burner tip end, especially including conical, frusto-conical and hemispherical. The hemispherical configuration is particularly advantageous in that it tends to minimize the exposed surface area as compared to the surface area that would be exposed by a cylinder of comparable diameter.

Although the invention has been described with reference to specific forms of apparatus, various equivalents may be substituted without departing from the spirit and scope of the invention defined in the appended claims. For example, ports 14 may be of various sizes, shapes and distributions so long as a substantially constant ratio is maintained between each cross-sectional flow area within converging member 12 and the sum of the port areas downstream from that cross-sectional flow area. Use of different curvatures of the converging portions of the tip, or additional embodiments and modifications which represent equivalents of the invention, can be envisioned by one of ordinary skill in the art in light of this teaching and are intended to be within the spirit and scope of the invention as defined in the appended claims.

What is claimed is:

1. A burner having resistance against backfire in said burner, said burner having a nozzle and having an upstream portion for receiving air and fuel and a downstream portion arranged for delivering said air and fuel into said nozzle, said burner comprising:

means providing an inlet connected to said upstream portion of said burner for admitting said air and fuel;

said burner having a body portion positioned downstream of said inlet defining a body passage through which said air and fuel are caused to flow;

said nozzle having a tip portion positioned downstream of said body portion, and having a tip passage through which said air and fuel are caused to flow, said tip portion converging in a downstream direction and having a multiplicity of tip openings for conducting a portion of said fuel and air from said tip portion, said tip openings being sized and positioned so that the cross-sectional area of substantially any cross section of said tip portion containing the burner tip openings is substantially equal to or less than the sum of the areas of those of those openings that are located at said cross-sectional area plus those located downstream of said cross-sectional area throughout said tip portion, thereby maintaining a substantially constant pressure throughout the interior of said tip portion and preventing substantial laminar air and fuel flow along said tip portion.

2. The burner according to claim 1, wherein the total area of said tip openings is greater than the cross-sectional area of said burner body passage.

3. The burner according to claim 1, wherein the ratio between said cross-sectional area of said tip passage and said sum of areas of those of said openings that are located downstream of said cross-sectional area is about substantially the same throughout the length of said tip portion.

4. The burner according to claim 1, wherein said openings in said tip portion have a substantially uniform size.

5. The burner according to claim 1, wherein said tip has a substantially spherical configuration.

6. The burner according to claim 1, wherein said tip has a substantially conical configuration.

7. A burner having improved resistance against backfire in said burner, said burner having an upstream end portion for receiving a feed of air and fuel and a downstream end portion for delivering said air and fuel, said burner comprising:

means forming an inlet connected to said upstream end portion of said burner for introduction of said air and fuel;

a body positioned downstream from said inlet defining a body passage through which said air and fuel flows;

said body having a tip portion positioned downstream from said inlet, said tip portion having a longitudinal axis and a wall defining a tip passage communicating with said body passage through which said air and fuel flows, said tip portion having a substantially conical shape wherein said wall converges in a downstream direction along the length of said tip portion, said wall of said tip portion having a multiplicity of openings for the flow of said air and fuel from said tip passage to form a flame, said openings being sized and positioned on said wall so that a ratio between a given cross-sectional area of said tip passage containing the burner tip openings and the sum of areas of said openings located downstream of said cross-sectional area remains substantially constant throughout the length of said tip portion, thereby maintaining a substantially constant pressure within said tip portion; and a transversely-extending deflector means connected to said tip portion and extending radially outwardly from said tip portion at an angle to an axis of said burner to direct at least a portion of said burner flame substantially transversely outwardly with respect to said longitudinal axis of said tip.

8. The burner according to claim 7, further comprising a fastening member connecting said deflector means to said tip portion of said burner, a portion of said fastening member extending into said tip passage and positioned to partially obstruct flow of said air and fuel through at least one of said openings in said wall of said tip portion.

9. The burner according to claim 7, wherein said ratio between a cross-sectional area of said tip passage and a sum of areas of said openings located downstream of said cross-sectional area is about the same throughout the length of said tip portion.

10. The burner according to claim 7, wherein said openings in said wall of said tip portion have a substantially uniform size.

11. The burner according to claim 7, wherein said tip is substantially spherical in configuration.

12. The burner according to claim 7, wherein said tip is substantially conical in configuration.

13. The burner according to claim 7, wherein said tip is a hemisphere.

14. The burner according to claim 7, wherein said tip is a frustum of a cone.

15. The burner according to claim 7, wherein the total area of said tip openings is greater than the cross-sectional area of said body passage.

* * * * *